United States Patent [19]

Steinhage et al.

[11] 4,310,781

[45] Jan. 12, 1982

[54] CONTROLLABLE HYDROGEN SOURCE WITH GETTERING EFFECT FOR ELECTRONIC TUBES

[75] Inventors: Peter-Wilhelm Steinhage, Wiesbaden; Roland Heinz, Wallbach, both of Fed. Rep. of Germany

[73] Assignee: Heimann GmbH, Wiesbaden, Fed. Rep. of Germany

[21] Appl. No.: 944,581

[22] Filed: Sep. 21, 1978

[30] Foreign Application Priority Data

Sep. 30, 1977 [DE] Fed. Rep. of Germany ..... 2744146

[51] Int. Cl.[3] ..... H01J 19/70; H01J 61/24

[52] U.S. Cl. ..... 313/180

[58] Field of Search ..... 313/180

[56] References Cited

U.S. PATENT DOCUMENTS

| | | | |
|---|---|---|---|
| 2,735,019 | 2/1956 | Dewan et al. | 313/180 X |
| 3,584,253 | 6/1971 | Wintzer | 313/180 |
| 3,801,850 | 4/1974 | Maegdefessel et al. | 313/174 |
| 3,820,919 | 6/1974 | Katz | 313/174 X |
| 4,031,394 | 6/1977 | Feliz et al. | 313/180 X |

FOREIGN PATENT DOCUMENTS

| | | | |
|---|---|---|---|
| 2158949 | 5/1973 | Fed. Rep. of Germany . | |
| 2315764 | 1/1977 | France . | |
| 40-2961 | 2/1965 | Japan | 313/481 |
| 868448 | 5/1961 | United Kingdom | 313/180 |
| 915664 | 1/1963 | United Kingdom | 313/180 |

*Primary Examiner*—Robert Segal

*Attorney, Agent, or Firm*—Hill, Van Santen, Steadman, Chiara & Simpson

[57] ABSTRACT

A Zr-C sintered body is charged with $H_2$ to form zirconium hydride within the body and such body is positioned in working association with a heating means within an electronic tube, such as a vidicon tube, which utilizes hydrogen as a supporting gas. During an operation of such tube, the sintered body is heated and releases an amount of $H_2$ therefrom as a function of the temperature while the sintered body acts as a getter for any residual gases within the tube, other than $H_2$, at elevated operating temperatures.

10 Claims, 2 Drawing Figures

CONTROLLABLE HYDROGEN SOURCE WITH GETTERING EFFECT FOR ELECTRONIC TUBES

BACKGROUND OF THE INVENTION

1. Field of the Invention

The invention relates to gettering devices and somewhat more particularly to a controllable hydrogen source having a gettering effect for use in electronic tubes using hydrogen as a supporting gas and having a heating means therein.

2. Prior Art

In order to function, certain high vacuum electron beam tubes must be filled with a supporting gas at pressures in order of $10^{-3}$ Torr. Generally, such gas charge functions to generate ions via the electron beam. A particular example of this type of tube is a vidicon tube having a highly insulated pyroelectric image plate and operating with a stabilized cathode potential.

In such tubes, it is preferable to use hydrogen as a supporting gas since with hydrogen the damage done to an oxide cathode by ion bombardment is minimal.

In order to maintain a static high vacuum condition in an electronic tube, a getter is generally required to consume or at least bind any residual gases therein, mostly released by the electron beam during tube operation. In order to achieve such gettering in tubes working on hydrogen, only getters which do not absorb or bind hydrogen during tube operation can be utilized.

In order to optimize the relationship between electron beam density and ion density within an electron tube, the hydrogen pressure therein should be variable within certain limits. Certain metals, such as zirconium or tantalum for example, are useful in achieving the foregoing requirements. Typically, a zirconium or tantalum body is highly charged with hydrogen and positioned within the tube as a heatable plate or the like. During tube operation, such plate warms up and releases a quantity of hydrogen as a function of the plate temperature. On cooling, the released hydrogen is reabsorbed by such plate. However, such metal getter elements do not bind other residual gas that may be present in electronic tubes at relative high temperatures. Accordingly, in such cases it is necessary to provide getters which are selective for such residual gases but which do not consume or bind hydrogen. This necessity creates considerable technological problems and the invention provides method and means of substantial avoiding such problems and attendant prior art disadvantages.

SUMMARY OF THE INVENTION

The invention provides a controllable hydrogen source having a gettering effect for use in an electronic tube having hydrogen as a supporting gas and a heating means therein.

In accordance with the principles of the invention, a sintered getter element composed of zirconium and carbon, which are known per se as gettering materials, is charged with hydrogen so that zirconium hydride is formed within such element, which is then operationally positioned on, or, incorporated with, a heating means within an electronic tube, such as a vidicon tube, which utilizes hydrogen as a supporting gas. During tube operation, the getter element releases a quantity of hydrogen as a function of the temperature of the heating means while any other residual gases absorbed within such getter element remain attached thereto and any other residual gases, other than hydrogen, released or generated at the relatively high tube operating temperatures are gettered by such element.

In certain embodiments of the invention, the getter element of the invention is comprised of a sintered zirconiumcarbon body having zirconicum hydride therein. In other embodiment of the invention, the getter element is comprised of zirconium hydride and carbon. The getter element of the invention may be a free-standing body or a coating on select tube surfaces such as a tube heating coil or the like. In certain embodiments of the invention, the sintered getter element or body may be enclosed within a closely confining metal mesh cage. In yet other embodiments of the invention, the sintered getter element or body may be formed as a hollow cylinder. In certain forms of this last-mentioned embodiment, the inside wall of such hollow cylinder may be supported by a rolled sheet of tantalum, which in preferred embodiments, is hydrogenated before being associated with the getter element.

In a preferred method embodiment of the invention, a controllable hydrogen source having a gettering effect for use in electronic tubes using hydrogen as a supporting gas and having heating means therein is produced by forming or providing a getter body comprised of zirconium hydride and carbon, subjecting such body to vacuum and heat at a temperature of about 1000° C. for a period time sufficient to drive off at least some hydrogen bound within the zirconium hydride and activate the gettering facility thereof and then charging the resultant body with a desired amount of hydrogen.

BRIEF DESCRIPTION OF THE DRAWINGS

FIG. 1 is an elevated, somewhat schematic, view of an embodiment of a controllable hydrogen source constructed in accordance with the principles of the invention and in working association with an electronic tube heating means; and.

DESCRIPTION OF THE PREFERRED EMBODIMENTS

Figure 1:
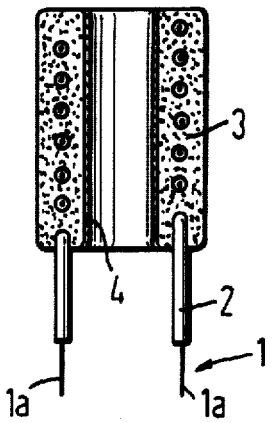

The invention provides a controllable hydrogen source having a gettering effect for use in electronic tubes utilizing hydrogen as a supporting gas and having a heating means therein and a method of producing such hydrogen sources.

In accordance with the principles of the invention, a controllable hydrogen source having a gettering effect is formed by admixing powdered zirconium and carbon, which are known per se as gettering materials, forming a body from the resultant mixture, sintering the so-formed body and then charging the resultant body with hydrogen as to form zirconium hydride within such body.

The resultant controllable hydrogen source is positioned within an electronic tube, such as a vidicon tube, which utilizes hydrogen as a supporting gas and has a heating means therein so that the hydrogen source is in working or operating association with the heating means of such tube. During tube operation, a controlled amount of hydrogen is released from such source as a function of the temperature of the heating means. Any residual gas present in the hydrogen source remains bound thereto and, at the relatively high tube operating temperatures, any residual gas, other than hydrogen, which may be present within such tube is absorbed by such hydrogen source.

When zirconium hydride is formed within a sintered zirconium-carbon body, it may cause, in certain circumstances, cracks or the like in such body since zirconium hydride has a greater specific volume than zirconium. Of course, this is undesirable since such cracks may lead to distintegration of the ultimate hydrogen source or gettering means. In order to avoid or minimize disintegration of a sintered body (which may be a free-standing body or a coating on select supporting surfaces) having zirconium hydride therein, it is preferable to enclose such body in a relatively closely confining metal mesh cage.

In certain embodiments of the invention, the controllable hydrogen source or gettering body may be formed as a hollow cylinder, perferable with the interior wall thereof supported by a rolled sheet of tantalum, which is preferably subjected to hydrogenation before being associated with the getter body.

In accordance with a preferred method embodiment of the invention, a getter body or controllable hydrogen source is produced by making a sintered body from zirconium hydride and carbon, subjecting such sintered body to vacuum conditions and heat at a temperature of about 1000° C. for a period of time sufficient to drive out at least some hydrogen absorbed within the zirconium hydride and to activate the gettering facility of such body and then to charge the so-treated with a desired amount of hydrogen.

This process substantially avoids any swelling or expansion and possible disintegration of the getter body since the volume of the sintered body remains substantially constant during the vacuum-heat treatment step and during the hydrogen charging step. Further, the gettering properties of the resultant body or controlled hydrogen source are not impaired but are fully retained.

Referring now to the drawing, wherein parts which are not essential for an understanding of the invention by those skilled in that art have been omitted and/or have not been referenced FIG. 1 shows, a typical electronic tube heating coil 1 having an insulating coating 2, composed of, for example, aluminum oxide. Leads 1*a* are provided for connection with the tube electrode systems and/or with an electrical potential so that electrical heating energy is available for the heating coil. If desired or necessary, such heating coil may comprise a bifilar heater. A compact controllable hydrogen source or coating 3 is provided on at least select surface portions of heater 1 as shown. In the embodiment shown, coating 3 is supported by an outer wall of a hollow cylinder 4 formed of a rolled sheet of tantalum, which may be hydrogenated.

Figure 2:
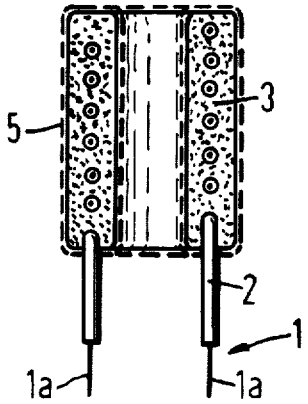
FIG. 2 is a somewhat similar view to that of FIG. 1 of another embodiment of a controllable hydrogen source constructed in accordance with the principles of the invention and in working associated with an electronic tube heating means.

FIG. 2 shows a typical electronic heating coil 1 substantially similar to that described in FIG. 1, except the compact controllable hydrogen source or coating 3 is confined or enclosed within a relatively closely confining metal mesh cage 5, which may, for example, be comprised of tantalum.

An exemplary method of applying such coating comprises providing a mixture of zirconium and carbon particles as a suspension in an alcohol, immersing select heater surfaces into such suspension so that a coating forms thereon and subjecting the so-coated surfaces to sintered conditions to form a solid, tightly adhering and porous coating. Thereafter, the so-formed coating is charged with a select amount of hydrogen so as to form zirconium hydride. In this manner, a controlled hydrogen source having a gettering effect and a very large and active getter surface is provided which can be controllably heated during tube operation to a select temperature to provide a variable amount of hydrogen within the tube and getter any residual gases therein.

A controllable hydrogen source produced in accordance with the principles of the invention, may also be formed or provided as a totally free-standing element anywhere within an electronic tube, for example in or adjacent the tube electrode system or elsewhere. In other words the controllable hydrogen source of the invention may be located anywhere in an electronic tube where there is sufficient room and where electrical heating energy is available.

The foregoing is considered as illustrative only of the principles of the invention. Further, since numerous modifications and changes with readily occur to those skilled in the art, it is not desired to limit the invention to the exact construction and operation shown and described, and accordingly, all suitable modifications and equivalence may be resorted to, falling within the scope of the invention as claimed.

We claim as our invention:

1. In a controllable hydrogen source for insertion in an electronic tube having a heating means and hydrogen as a supporting gas, along with a body containing a metal hydride which is associated with said heating means so that such body releases a temperature-dependent amount of hydrogen when heated, the improvement comprising wherein:

said body is composed of a sintered mixture of zirconium and carbon, which are per se known as gettering materials, said body being charged with hydrogen so as to contain zirconium hydride therein whereby heating of said body releases a temperature-dependent quantity of hydrogen and any residual gases bonded onto said sintered mixture remain bonded thereon and said sintered mixture binds any other residual gases, besides hydrogen, generated during tube operation at relatively higher temperatures.

2. A controllable hydrogen source as defined in claim 1, wherein said sintered body is enclosed within a relatively closely confining metal mesh cage.

3. A controllable hydrogen source as defined in claim 1, wherein said sintered body is shaped in the form of a hollow cylinder and an inside wall of such cylinder is supported by rolled sheet of tantalum.

4. A controllable hydrogen source as defined in claim 3, wherein said tantalum sheet is hydrogenated.

5. A controllable hydrogen source as defined in claim 1, wherein said sintered body is comprised of zirconium hydride and carbon.

6. A method of producing a controllable hydrogen source having a gettering effect for use in an electronic tube using hydrogen as a supporting gas and having a heating means therein, comprising:

providing a sintered body comprised of zirconium hydride and carbon;

subjecting said body to vacuum and heat at a temperature of about 1000° C. for a period of time sufficient to drive off at least some hydrogen bound within the zirconium hydride; and charging the so-treated body with a select amount of hydrogen.

7. A method as defined in claim 6 wherein providing the sintered body comprised of zirconium hydride and carbon is accomplished by mixing powdered zirconium and carbon to form a substantially homogeneous mixture thereof, forming a body from such mixture, subjecting such body to sintering conditions, and charging the sintered body with hydrogen so the zirconium hydride forms.

8. A controllable hydrogen source having a getter effect for use in an electronic tube using hydrogen as a supporting gas and having a heating means therein, comprising a sintered body comprised of a mixture of zirconium, carbon, and zirconium hydride, said body being operationally connected to the heating means of said electronic tube.

9. A controllable hydrogen source as defined in claim 8, wherein said sintered body is positioned on a surface of said heating means.

10. A controllable hydrogen source as defined in claim 8, wherein said electronic tube is a vidicon tube having a heating coil therein and said sintered body is located on select outer surfaces of said heating coil.

* * * * *